US008960143B2

(12) United States Patent
Meintschel et al.

(10) Patent No.: US 8,960,143 B2
(45) Date of Patent: Feb. 24, 2015

(54) VALVE DRIVE TRAIN ARRANGEMENT

(75) Inventors: Jens Meintschel, Bernsdorf (DE); Thomas Stolk, Kirchheim (DE); Alexander von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 221 days.

(21) Appl. No.: 13/066,167

(22) Filed: Apr. 7, 2011

(65) Prior Publication Data

US 2011/0203541 A1 Aug. 25, 2011

Related U.S. Application Data

(63) Continuation-in-part of application No. PCT/EP2009/006569, filed on Sep. 10, 2009.

(30) Foreign Application Priority Data

Oct. 8, 2008 (DE) ..... 10 2008 050 776

(51) Int. Cl.
*F01L 1/34* (2006.01)
*F01L 1/344* (2006.01)
*F01L 13/00* (2006.01)

(52) U.S. Cl.
CPC ..... *F01L 1/34* (2013.01); *F01L 1/34413* (2013.01); *F01L 13/0042* (2013.01); *F01L 2013/0052* (2013.01)
USPC ..... 123/90.18; 123/90.16; 123/90.17

(58) Field of Classification Search
USPC ..... 123/90.18
See application file for complete search history.

(56) References Cited

U.S. PATENT DOCUMENTS

| | | | | |
|---|---|---|---|---|
| 5,129,407 | A * | 7/1992 | Phillips | 123/90.18 |
| 5,417,186 | A | 5/1995 | Elrod | |
| 6,725,817 | B2 * | 4/2004 | Methley et al. | 123/90.17 |
| 6,832,586 | B2 * | 12/2004 | Williams | 123/90.17 |
| 7,198,015 | B2 * | 4/2007 | Mobley | 123/90.18 |
| 7,444,968 | B2 * | 11/2008 | Lancefield et al. | 123/90.17 |
| 7,540,267 | B1 * | 6/2009 | Sellars | 123/90.31 |
| 8,186,319 | B2 * | 5/2012 | Pluta et al. | 123/90.17 |
| 2007/0034184 | A1 * | 2/2007 | Dengler | 123/90.17 |
| 2007/0119402 | A1 * | 5/2007 | Lancefield et al. | 123/90.17 |

FOREIGN PATENT DOCUMENTS

| | | |
|---|---|---|
| DE | 39 43 426 | 4/1991 |
| DE | 42 26 798 | 2/1994 |
| DE | 42 30 074 | 3/1994 |
| DE | 10 2004 002 290 | 8/2005 |
| DE | 10 2007 010 152 | 4/2008 |
| DE | 10 2007 010 154 | 6/2008 |

(Continued)

*Primary Examiner* — Thomas Denion
*Assistant Examiner* — Steven D Shipe
(74) *Attorney, Agent, or Firm* — Klaus J. Bach

(57) ABSTRACT

In a valve drive train device of an internal combustion engine, comprising a phase adjustment device for the adjustment of a phase position between a primary cam and a secondary cam which belong to a same category and which are arranged coaxial with one another, at least one is assigned to a pair of cams for executing a valve lift changeover so as to allow the valve drive train device to be instantly adjusted to a momentary operating situation.

4 Claims, 5 Drawing Sheets

(56) References Cited

FOREIGN PATENT DOCUMENTS

| | | |
|---|---|---|
| DE | 10 2007 002 802 | 7/2008 |
| DE | 10 2007 010 150 | 9/2008 |
| EP | 0 582 846 | 2/1994 |
| GB | 2 438 628 | 12/2007 |
| JP | 2001 173413 | 6/2001 |
| JP | 2002 054410 | 2/2002 |
| JP | 2006 105062 | 4/2006 |
| WO | WO 95/00748 | 1/1995 |

* cited by examiner

VALVE DRIVE TRAIN ARRANGEMENT

This is a Continuation-In-Part application of pending international patent application PCT/EP2009/006569 filed Sep. 10, 2009 and claiming the priority of German patent application 10 2008 050 776.8 filed Oct. 8, 2008.

BACKGROUND OF THE INVENTION

The invention relates to a valve drive train device for an internal combustion engine of a motor vehicle.

WO 95/00748 already discloses a valve drive train device of an internal combustion engine comprising a phase adjustment device for the adjustment a phase position between primary cams and secondary cams which are arranged coaxially relative to each other.

A valve drive train device with primary cams and secondary cams, of which at least one is assigned to a pair of cams configured to provide a valve lift change-over, is further disclosed in DE 10 2007 010154 A1.

It is the principal object of the present invention to provide a valve drive train device by means of which the efficiency of an internal combustion engine can be increased.

SUMMARY OF THE INVENTION

In a valve drive train device of an internal combustion engine, comprising a phase adjustment device for the adjustment of a phase position between a primary cam and a secondary cam which belong to a same category and which are arranged coaxial with one another, at least one is assigned to a pair of cams for executing a valve lift changeover.

This allows the valve drive train device to be momentarily adjusted to a momentary operating situation, for example part-load or full-load operation, so that the efficiency of the internal combustion engine can be increased. The phrase "at least one primary cam" should in particular be understood to describe one or more cams which are functionally assigned to one another, such as in particular all cams which have a fixed primary phase position with respect to one another. The phrase "at least one secondary cam" should in particular be understood to describe one or more cams which are functionally assigned to one another, such as in particular all cams which have a fixed secondary phase position with respect to one another. The phase adjustment device is advantageously provided for the adjustment of a phase position, which is designed as a difference between the primary phase position and the secondary phase position. The phrase "adjustment of a phase position" should in particular be understood to describe an adjustment wherein a valve lift and or an injection period remains unchanged. A variant with third cams having a third phase position which can be adjusted relative to the primary phase position and the secondary phase position is also conceivable. The term "category" should further in particular be understood to describe an assignment with respect to an assignment of an inlet side or an outlet side.

The phrase "valve lift changeover" should in particular be understood to describe a changeover with respect to the valve lift and/or the valve opening period. The phrase "pair of cams" should further in particular be understood to describe two or more immediately adjacent cams which are provided for the actuation of a charge exchange valve. The cams of such a pair preferably have different contours, for example a full lift, a partial lift and/or a zero lift. A pair of cams may in principle be designed as a primary pair of cams and only include primary cams. Alternatively, a pair of cams may be designed as a secondary pair of cams and only include secondary cams. Mixed pairs of cams with primary and secondary cams are, however, conceivable as well. The term "provided" should in particular be understood to mean "specially designed and/or equipped".

It is further proposed that the valve drive train device should include at least one primary cam element comprising the primary cam and at least one secondary cam element comprising the secondary cam. In this way, a switching capability for the valve lift changeover of the primary cams and/or of the secondary cams can be made available by simple means. In this context, it is in particular advantageous if the primary cam element and the secondary cam element are axially displaceable. A primary cam element may in principle include only a single primary cam or alternatively several primary cams. The secondary cam element, too, may in principle include a single secondary cam or several secondary cams.

It is further proposed that the primary cam element and the secondary cam element should be coupled to each other. In this, way, there is no need for separate actuator systems for the primary cam element and the secondary cam element. It is in particular advantageous if the primary cam element and the secondary cam element are coupled to each other in an axially fixed arrangement while being rotatable with respect to each other. In this way, the phase adjustment device and the valve lift changeover can be designed independent of each other, so that the valve drive train device can be adapted particularly well to the current operating situation. The term "rotatable" should in particular be understood to mean that a phase position between the primary cam elements and the secondary cam elements is freely adjustable but defined by means of the phase adjustment device at least in a sub-region, i.e. that the primary cam elements and the secondary cam elements are coupled to each other in a way which allows them to rotate relative to each other and that they are adjusted relative to each other in a phase-defined way.

It is further proposed that the valve drive train device should comprise at least one primary and/or secondary drive shaft unit which is provided to drive at least one primary cam and/or at least one secondary cam. In this way, a simple drive can be designed for the primary cam and/or the secondary cam. The phrase "primary drive shaft unit" should in particular be understood to describe a drive shaft unit which is provided to drive the primary cams only. The phrase "secondary drive shaft unit" should in particular be understood to describe a drive shaft unit which is provided to drive the secondary cams only. The phrase "primary and secondary drive shaft unit" should in particular be understood to describe a drive shaft unit which is provided to drive both the primary cams and the secondary cams. The at least one primary cam or the at least one secondary cam respectively is preferably non-rotatably connected to the primary drive shaft unit or the secondary drive shaft unit respectively.

It is in particular proposed that the primary and/or secondary drive shaft unit should at least partially be axially displaceable for adjusting the phase position. This makes the adjustment of the phase position particularly simple. It is in particular possible to implement a mechanical adjustment device for the phase position by simple means. In principle, it is conceivable to provide a further primary and/or secondary drive shaft unit which is at least partially independent of the first primary and/or secondary drive shaft unit. In this context, it is particularly advantageous if the two primary and/or secondary drive shaft units are non-rotatably coupled to each other while being axially displaceable with respect to each other, whereby a further adjustment facility for the independent phase adjustment of further primary and secondary cams can be implemented by simple means.

It is further proposed that the phase adjustment device should comprise at least one adjustment actuator system which is provided for the axial displacement of the at least one primary and/or secondary drive shaft unit. In this way, an independent adjustment of the phase position between the primary drive shaft unit and the secondary drive shaft unit can be provided.

A variant of the invention with a primary drive shaft unit and a secondary drive shaft unit which is at least partially separate from the former is further proposed in order to drive the primary cam and the secondary cam. In this way, two separate parallel power flows can be provided, which makes phase adjustment simple. The primary drive shaft unit and the secondary drive shaft unit are preferably arranged to be coaxial. Two separate parallel power flows run via the primary drive shaft unit and the secondary drive shaft unit.

A variant with at least one coupling unit which is provided for a secure axial connection between the primary cam elements and the secondary cam elements is further proposed. In this way, there is no need for an additional switching actuator system for a valve lift changeover which would act individually on the primary cam elements and the secondary cam elements.

A variant is in particular proposed in which the at least one coupling unit is provided for the non-rotatable connection of the primary cam elements and the secondary cam elements. In this way, a structurally simple adjustment of the phase position of the secondary cam elements can be implemented, as the phase position of the secondary cam elements can simply be adjusted by adjusting the phase position of the secondary drive shaft unit.

In a further development of the invention, it is proposed that at least one common primary and secondary drive shaft unit should be provided to drive the primary cam and the secondary cam. In this way, a particularly simple coupling to a drive shaft, for example a crankshaft, can be obtained. The term "common" should in this context in particular be understood to imply that a primary and/or secondary drive shaft unit provides the drive for primary cam elements and secondary cam elements.

It is further proposed that the valve drive train device should comprise a primary phase adjusting unit which is provided for an adjustment of a phase position of the at least one primary cam. In this way, phase adjustment can be made more variable. By improved carburetion, in particular, fuel consumption can be reduced and a low pollutant content of the exhaust gases can be ensured. The phrase "primary phase adjusting unit" should in this context in particular be understood to describe a phase adjusting unit which is provided for the adjustment of the phase position of the primary cams only. The primary phase adjusting unit is advantageously designed as a vane-type adjuster.

It is further proposed that the valve drive train device should comprise a secondary phase adjusting unit which is provided for an adjustment of a phase position of the at least one secondary cam. In this way, the secondary cam can be adjusted independently, in particular with respect to a crankshaft. The phrase "secondary phase adjusting unit" should in this context in particular be understood as a description for a phase adjusting unit for the phase position of the at least one secondary cam. It is in particular to be understood to describe a phase adjusting unit which is independent of the primary phase adjusting unit. A particularly advantageous variant comprises secondary phase adjusting means each of which is provided for the adjustment of a part of the secondary cams only. The secondary phase adjusting means may advantageously be provided for the adjustment of a single secondary cam or a pair of secondary cams. In this way, a secondary phase adjusting unit by means of which the secondary cams can be adjusted to different angles can be made available by simple means. In principle, an analogous design for the primary phase adjusting unit would be conceivable.

It is further proposed that the primary phase adjusting unit and/or the secondary phase adjusting unit should have at least one helically toothed sliding seat which is provided for an adjustment of the phase position. In this way, an infinitely variable adjustment of the phase position can be made available. By means of helically toothed sliding seats, the secondary phase adjusting means for the adjustment of a part of the secondary cams can in particular be made available by simple means.

It is further proposed that the valve drive train device should comprise a common drive shaft link element which is provided for connecting the primary cam and the secondary cam to a crankshaft. In this way, a total torque can easily be transmitted to the primary cams and the secondary cams. The phrase "drive shaft link element" should in this context in particular be understood to describe a pulley or a toothed disc used for connection to the crankshaft by means of a timing belt or a timing chain.

The invention will become more readily apparent from the following description of a particular embodiment with reference to the drawings. The drawings show four embodiments of the invention.

DESCRIPTION OF PARTICULAR EMBODIMENTS OF THE INVENTION

Figure 1:
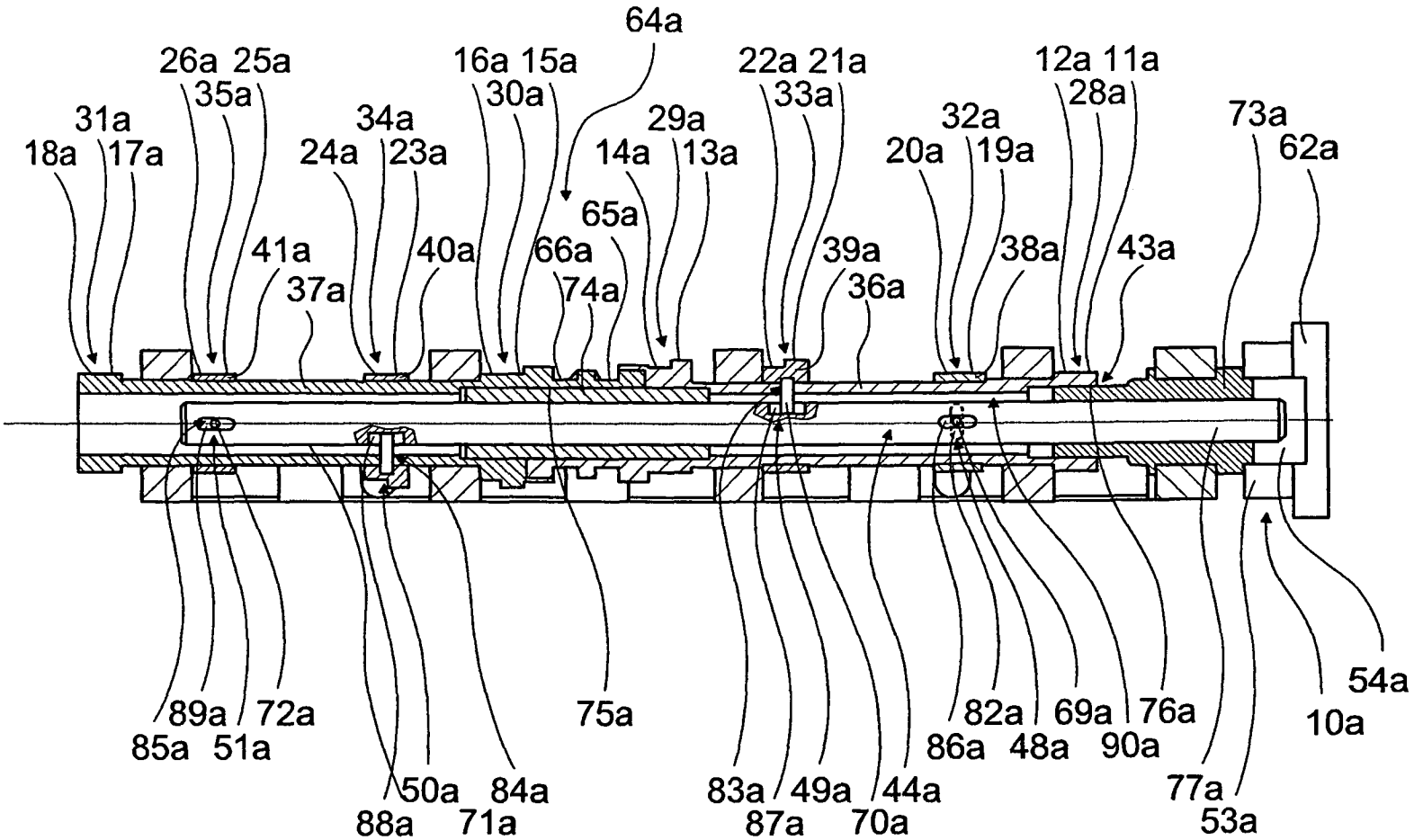
FIG. 1 is an axial cross-sectional view of a first valve drive train device according to the invention.

FIG. 1 shows an axial cross-sectional view of a valve drive train device of an internal combustion engine according to the invention. The valve drive train device comprises two primary cam elements 36*a*, 37*a* and four secondary cam elements 38*a*, 39*a*, 40*a*, 41*a*. The primary cam elements 36*a*, 37*a* are coupled to a primary drive shaft unit 43*a*for rotation therewith. The secondary cam elements 38*a*, 39*a*, 40*a*, 41*a* are coupled to a secondary drive shaft unit 44*a*. By means of the primary drive shaft unit 43*a* and the secondary drive shaft unit 44*a*, the primary cam elements 36*a*, 37*a* and the secondary cam elements 38*a*, 39*a*, 40*a*, 41*a* are non-rotatably connected to a drive shaft connecting element 62*a*.

The valve drive train device comprises four pairs of cams with cam structure 11*a*, 12; 13*a*, 14; 19A, 20*a*, 21*a*, 22*a*, 23*a*, 24*a*, 25*a*, 26*a*, 28*a*, 29*a*; 30*a*, 31*a* which are designed as primary pairs of cams and four pairs of cams 32*a*, 33*a*,34*a*, 35*a* which are secondary cam structures. The cam stuctures 28*a*, 29*a*, 30*a*, 31*a* which are designed as primary pairs of cams are assigned to the primary cam elements 36*a*, 37*a*. The pairs of cams 32*a*, 33*a*, 34*a*, 35*a* which are designed as secondary pairs of cams are assigned to the secondary cam elements 38*a*, 39*a*, 40*a*, 41*a*. On each of the primary cam elements 36*a*, 37*a*, two of the pairs of cams 28*a*, 29*a*, 30*a*, 31*a* which are designed as primary pairs of cams are arranged. On each of the secondary cam elements 38*a*, 39*a*, 40*a*, 41*a*, one of the pairs of cams 32*a*, 33*a*, 34*a*, 35*a* which are designed as secondary pairs of cams is arranged. On each of the secondary cam elements 38*a*, 39*a*, 40*a*, 41*a*, one of the pairs of cams 32*a*, 33*a*, 34*a*, 35*a* which are designed as secondary pairs of cams is arranged. An axial width of the secondary cam elements 38*a*,39*a*, 40*a*, 41*a* is approximately equal to an axial width of the pairs of cam 32*a*, 33*a*, 34*a*, 35*a* arranged thereon.

Each of the pairs of cams 28*a*, 29*a*, 30*a*, 31*a* which are designed as primary pairs of cams comprises two primary cams 11*a*-18*a* which are arranged immediately adjacent to each other. The pair of cams 28*a* comprises the two primary cams 11*a*, 12*a* which are arranged immediately adjacent to each other. The other pairs of cams 29*a*, 30*a*, 31*a* are designed in an analogous manner. The primary cams 11*a*-18*a* of a pair of cams 28*a*, 29*a*, 30*a*, 31*a* have different cam contours and are each assigned to one of four charge exchange valves which are not shown in detail in the drawing. The primary cam elements 36*a*, 37*a* and the primary cams 11*a*-18*a* arranged thereon are designed as single pieces.

Each of the pairs of cams 32*a*, 33*a*, 34*a*, 35*a* which are designed as secondary pairs of cams comprises two secondary cams 19*a*-26*a* which are arranged immediately adjacent to each other. The secondary cams 19*a*-26*a* of one of the pairs of cams 32*a*, 33*a*, 34*a*, 35*a* likewise have different contours and are each assigned to one of four charge exchange valves which are not shown in detail in the drawing. The secondary cam elements 38*a*, 39*a*, 40*a*, 41*a* and the secondary cams 19*a*-26*a* are designed as single pieces. The primary cams 11*a*-18*a* are of the same category and the secondary cams 19*a*-26*a* belong to the same category. They are all coaxial with each other and arranged in pairs.

The primary cam elements 36*a*, 37*a* and the secondary cam elements 38*a*, 39*a*, 40*a*, 41*a* are axially displaceable. Each of the primary cam elements 36*a*, 37*a* and the secondary cam elements 38*a*, 39*a*, 40*a*, 41*a* has two switching positions, each of the primary cams 11*a*-18*a* and the secondary cams 19*a*-26*a* being assigned to one of the switching positions. Each of the pairs of cams 28*a*-35*a* has one of the primary cams 11*a*, 13*a*, 15*a*, 17*a* and one of the secondary cams 19*a*, 21*a*, 23*a*, 25*a* respectively assigned to the first switching position. In addition, each of the pairs of cams 28*a*-35*a* has one of the primary cams 12*a*, 14*a*, 16*a*, 18*a* and one of the secondary cams 20*a*, 22*a*, 24*a*, 26*a* respectively assigned to the second switching position. By axially displacing the primary cam elements 36*a*, 37*a* and the secondary cam elements 38*a*, 39*a*, 40*a*, 41*a* respectively, the system switches within the pairs of cams 28*a*-35*a* from the primary cam 11*a*, 13*a*, 15*a*, 17*a* or the secondary cam 19*a*, 21*a*, 23*a*, 25*a* assigned to the first switching position to the primary cam 12*a*, 14*a*, 16*a*, 18*a* or the secondary cams 20*a*, 22*a*, 24*a*, 26*a* assigned to the second switching position. As the primary cams 11*a*-18*a* and the secondary cams 19*a*-26*a* within any one of the pairs of cams 28*a*-35*a* have different cam contours, a valve lift changeover is provided by means of the axial displacement of the primary cam elements 36*a*, 37*a* and the secondary cam elements 38*a*, 39*a*, 40*a*, 41*a* respectively.

The primary cam elements 36*a*, 37*a* with cams 28*a*, 29*a* 30*a*, 31*a* and the secondary cam elements with cams 38*a*, 39*a*, 40*a*, 41*a* are arranged in two groups which are displaced sequentially. The primary cam element 36*a* and the two secondary cam elements 38*a*, 39*a* belong to the first group. The primary cam element 36*a* and the secondary cam elements 38*a*, 39*a* are securely coupled to one another in the axial direction. The pairs of cam 28*a*, 29*a*,32*a*,33*a*, which are likewise assigned to the first group, are jointly displaced in the axial direction. The further primary cam element 37*a* and the two further secondary cam elements 40*a*, 41*a* belong to the second group.

In a first switching direction, the first group with the primary cam element 36*a* and the secondary cam elements 38*a*, 39*a* is displaced first. When the first group has been displaced completely, the second group with the primary cam element 37*a* and the secondary cam elements 40*a*, 41*a* is displaced. In a second switching direction, the second group is displaced first, followed by the first group.

Figure 2:
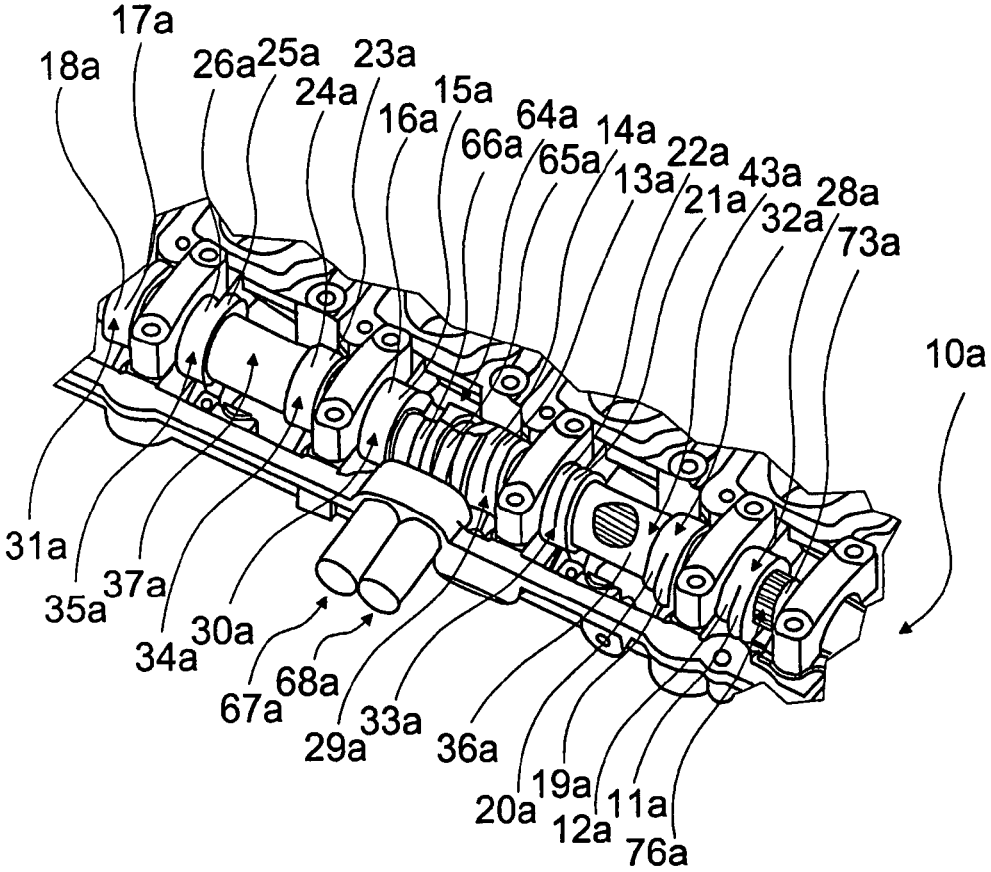
FIG. 2 is a perspective view of the valve drive train device.

The primary cam elements 36*a*, 37*a* and the secondary cam elements 38*a*, 39*a*, 40*a*, 41*a* are displaced sequentially by means of a gate 64*a* (cf. FIG. 2). In this process, the primary cam elements 36*a*, 37*a* and the secondary cam elements 38*a*, 39*a*, 40*a*, 41*a* are displaced in dependence on a rotary angle of the primary drive shaft unit 43*a*. To displace the primary cam elements 36*a*, 37*a* and the secondary cam elements 38*a*, 39*a*, 40*a*, 41*a*, the gate 64*a* has two gate ways 65*a*, 66*a*. The gate ways 65*a*, 66*a* are designed as groove-like indentations and produced directly in the primary cam elements 36*a*, 37*a*. In a region where the primary cam elements 36*a*, 37*a* adjoin each other, the primary cam elements 36*a*, 37*a* are L-shaped and intersect each other axially. In the circumferential direction, the primary cam elements 36*a*, 37*a* adopt a rotary angle of 180 degrees in this region. The gate ways 65*a*, 66*a* are arranged on the two primary cam elements 36*a*, 37*a* in sections. The gate ways 65*a*, 66*a* are S-shaped.

In order to displace the primary cam elements 36*a*, 37*a* and the secondary cam elements 38*a*, 39*a*, 40*a*, 41*a*, one of two switching pins 67*a*, 68*a* is extended and engages the associated gate way 65*a*, 66*a*. Owing to the S-shape of the gate ways 65*a*, 66*a*, a rotary motion of the primary drive shaft unit 43*a* applies an axial force to the primary cam elements 36*a*, 37*a* and the secondary cam elements 38*a*, 39*a*, 40*a*, 41*a*, whereby the primary cam elements 36*a*, 37*a* and the secondary cam elements 38*a*, 39*a*, 40*a*, 41*a* are displaced.

The valve drive train device comprises the primary drive shaft unit 43*a* for driving the primary cam elements 36*a*, 37*a* and the secondary drive shaft unit 44*a* for driving the secondary cam elements 38*a*, 39*a*, 40*a*, 41*a*. The primary drive shaft unit 43*a* is coaxial with the secondary drive shaft unit 44*a*. The primary drive shaft unit 43*a* is at least to a large extent designed as a hollow shaft 90*a*.

The secondary drive shaft unit 44*a* passes through the primary drive shaft unit 43*a*. The primary drive shaft unit 43*a* comprises a drive shaft connecting element 73*a*, the primary cam element 36*a*, a drive shaft coupling element 74*a* and the primary cam element 37*a*. A power flow for driving the pairs of cams 28*a*-35*a* which are driven by the primary drive shaft unit 43*a* runs from the drive shaft connecting element 73*a* via the primary cam element 36*a* and the drive shaft coupling element 74*a* to the primary cam element 37*a*. The primary cam element 36*a* and the primary cam element 37*a* are therefore arranged sequentially one behind the other in the power flow.

On a side facing the primary cam element 36*a*, the drive shaft connecting element 73*a* has a rotationally symmetric cross-section (cf. FIG. 2). The drive shaft connecting element 73*a* passes through a part of the adjacent primary cam element 36*a*. The drive shaft connecting element 73*a* is coupled to the adjacent primary cam element 36*a* by means of a polygonal connection 76*a*. Each of the two primary cam elements 36*a*, 37*a* is coupled to the drive shaft coupling element 74*a* by means of a triple square connection 75*a*. By means of the triple square connection 75*a* and the polygonal connection 76*a*, non-rotatable connections are implemented which allow the primary cam elements 36*a*, 37*a* to be displaced into their switching positions in groups. The secondary drive shaft unit 44*a* is designed in a single piece. It has a solid shaft 77*a* which is coaxial with the primary drive shaft unit 43*a*. The secondary drive shaft unit 44*a* passes through the drive shaft connecting element 73*a*, the first primary cam element 36*a*, the drive shaft coupling element 74*a* and a part of the second primary cam element 37*a*.

The primary drive shaft unit 43*a* and the secondary drive shaft unit 44*a* are designed separately. For driving the primary cam elements 36*a*, 37*a* and the secondary cam elements 38*a*, 39*a*, 40*a*, 41*a*, two separate parallel power flows are provided via the primary drive shaft unit 43*a* and the secondary drive shaft unit 44*a*. The primary drive shaft unit 43*a* and the secondary drive shaft unit 44*a* are, via a common drive shaft link element 62*a*, connected to a crankshaft not shown in detail, by means of which the primary cams 11*a*-18*a* and the secondary cams 19*a*- 26*a* are driven. To adjust a phase position of the primary cams 11*a*-18*a* and the secondary cams 19*a*-26*a* relative to the crankshaft, the valve drive train device comprises a phase adjustment device 10*a* with a primary phase adjusting unit 53*a* and a secondary phase adjusting unit 54*a*. The primary phase adjusting unit 53*a* and the secondary phase adjusting unit 54*a* are designed separately. The primary phase adjusting unit 53*a* is provided for the adjustment of all primary cams 11*a*-18 *a*. The secondary phase adjusting unit 54*a* is provided for the adjustment of all secondary cams 19*a*-26*a*. The primary phase adjusting unit 53*a* and the secondary phase adjusting unit 54*a* are designed as vane-type adjusters.

A phase position of the primary cams 11*a*-18*a* is adjusted by means of the primary drive shaft unit 43*a*. The primary drive shaft unit 43*a* is coupled to the primary phase adjusting unit 53*a* by means of the drive shaft link element 62*a*. As the primary cam elements 36*a*, 37*a* are partially integrated with the primary drive shaft unit 43*a*, the phase position of the primary cam elements 36*a*, 37*a* can be adjusted by means of the primary phase adjusting unit 53*a*. A phase position of the secondary cams 19*a*-26*a* is adjusted by means of the secondary drive shaft unit 44*a*. The solid shaft of the secondary drive shaft unit 44*a* is directly coupled to the secondary phase adjusting unit 54*a*.

The secondary cam elements 38*a*, 39*a*, 40*a*, 41*a* are rotatably mounted with respect to the primary cam elements 36*a*, 37*a* by means of bearing units. Two each of the secondary cam elements 38*a*, 39*a*, 40*a*, 41*a* are located on each of the primary cam elements 36*a*, 37*a*. The bearing units are designed as plain bearings. Each primary cam element 36*a*, 37*a* passes through the secondary cam elements 38*a*, 39*a*, 40*a*, 41*a* located thereon.

The primary cam element 36*a* and the secondary cam elements 38*a*, 39*a* of the first group are coupled to each other for axial movement. In order to couple the primary cam element 36*a* and the secondary cam elements 38*a*, 39*a* of the first group for axial movement, the valve drive train device comprises coupling units which connect the primary cam element 36*a* and the secondary cam elements 38*a*, 39*a* of the first group securely to each other in the axial direction. In this arrangement, one of the coupling units 48*a*, 49*a* is assigned to each of the secondary cam elements 38*a*, 39*a*.

The primary cam element 37*a* and the secondary cam elements 40*a*, 41*a* of the second group are coupled in an analogous manner. In order to couple the primary cam element 37*a* and the secondary cam elements 40*a*, 41*a*, the valve drive train device comprises coupling units. In this arrangement, one of the coupling units 50*a*, 51*a* is assigned to each of the secondary cam elements 40*a*, 41*a*.

The coupling units 48*a*, 49*a*, 50*a*, 51*a* are provided for the axially fixed connection of the primary cam elements 36*a*, 37*a* and the secondary cam elements 38*a*, 39*a*, 40*a*, 41*a* and for the non-rotatable connection of the secondary cam elements 38*a*, 39*a*, 40*a*, 41*a* and the secondary drive shaft unit 44*a*. The coupling units 48*a*, 49*a*, 50*a*, 51*a* comprise coupling elements 69*a*, 70*a*, 71*a*, 72*a* having the shape of pins. They are non-rotatably connected to the secondary cam elements 38*a*, 39*a*, 40*a*, 41*a* and axially fixed relative thereto. The coupling elements 69*a*, 70*a*, 71*a*, 72*a* have a radially oriented main direction. The primary cam elements 36*a*, 37*a* have slots 82*a*-85*a* oriented in the circumferential direction. The secondary drive shaft unit 44*a* has slots 86*a*-89*a* oriented in the axial direction. Each of the coupling elements 69*a*, 70*a*, 71*a*, 72*a* engages one of the slots 82*a*-85*a* of the primary cam elements 36*a*, 37*a* and one of the slots 86*a*-89*a* of the secondary drive shaft unit 44*a*. In the circumferential direction, the coupling elements 69*a*, 70*a*, 71*a*, 72*a* can be displaced in the slots 82*a*-85*a*. In the axial direction, the slots 82*a*-85*a* and the coupling elements 69*a*, 70*a*, 71*a*, 72*a* form a positive connection. In the axial direction, the coupling elements 69*a*, 70*a*, 71*a*, 72*a* can be displaced in the slots 86*a*-89*a*. In the circumferential direction, the slots 86*a*-89*a* and the coupling elements 69*a*, 70*a*, 71*a*, 72*a* form a positive connection.

Figure 3:
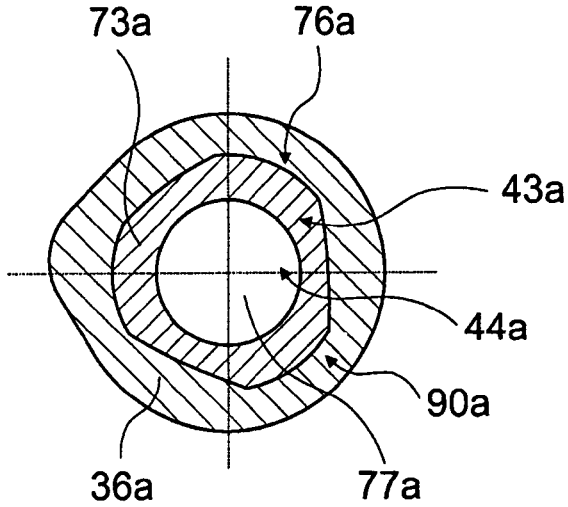
FIG. 3 is a cross-sectional view of the valve drive train device.
Figure 4:
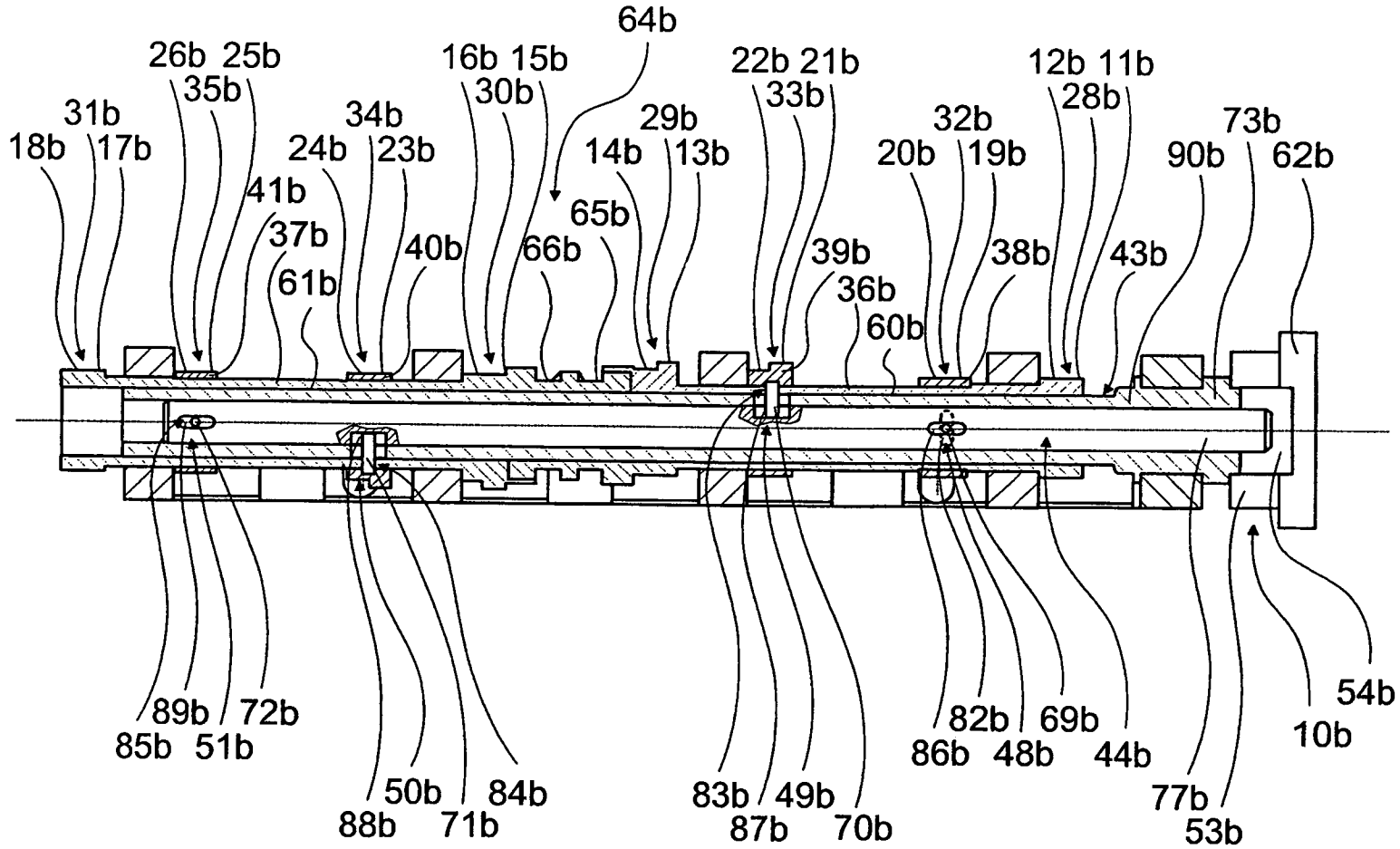
FIG. 4 is an axial cross-sectional view of a further embodiment of a valve drive train device according to the invention.
Figure 5:
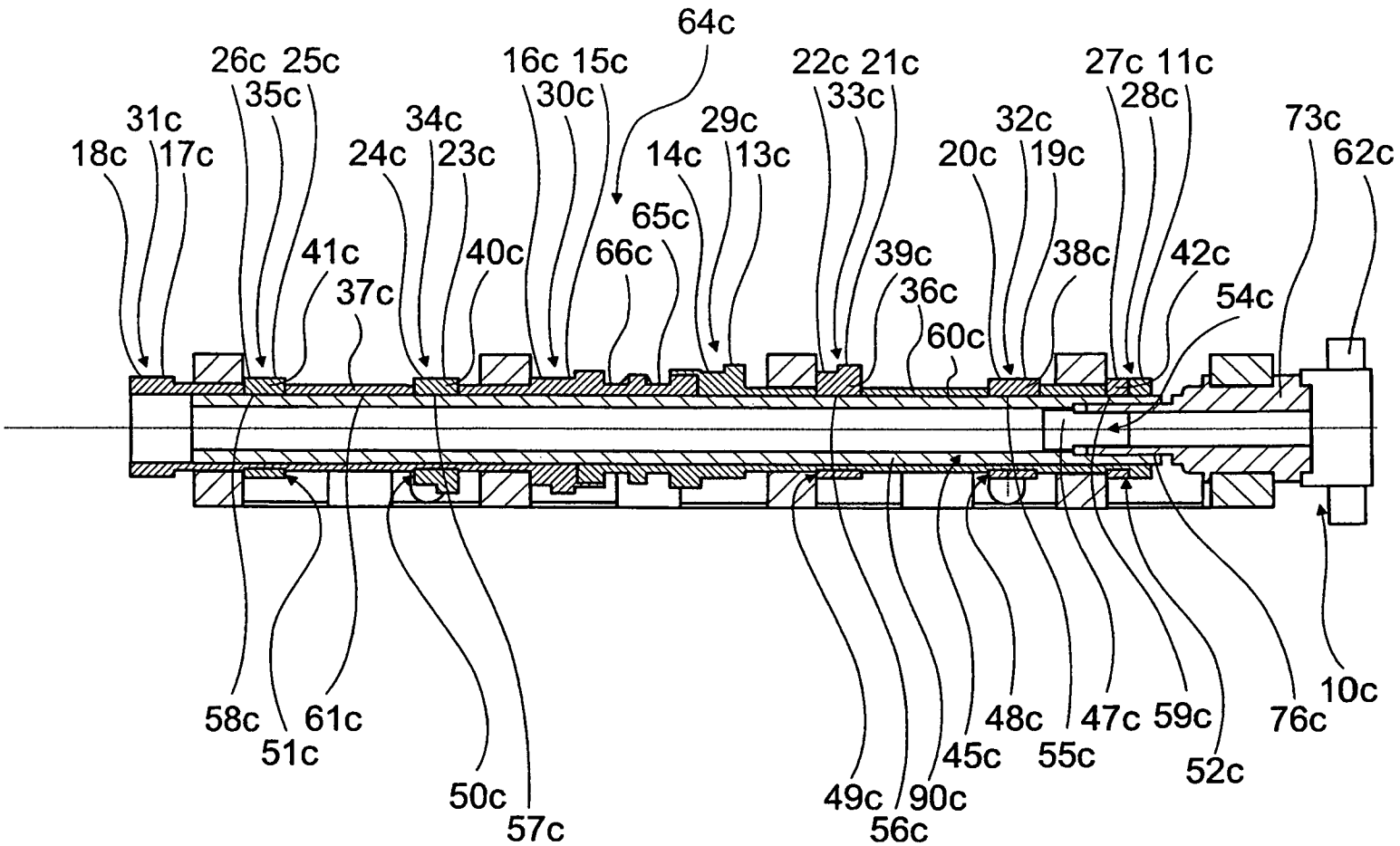
FIG. 5 is an axial cross-sectional view of a third valve drive train device.
Figure 6:
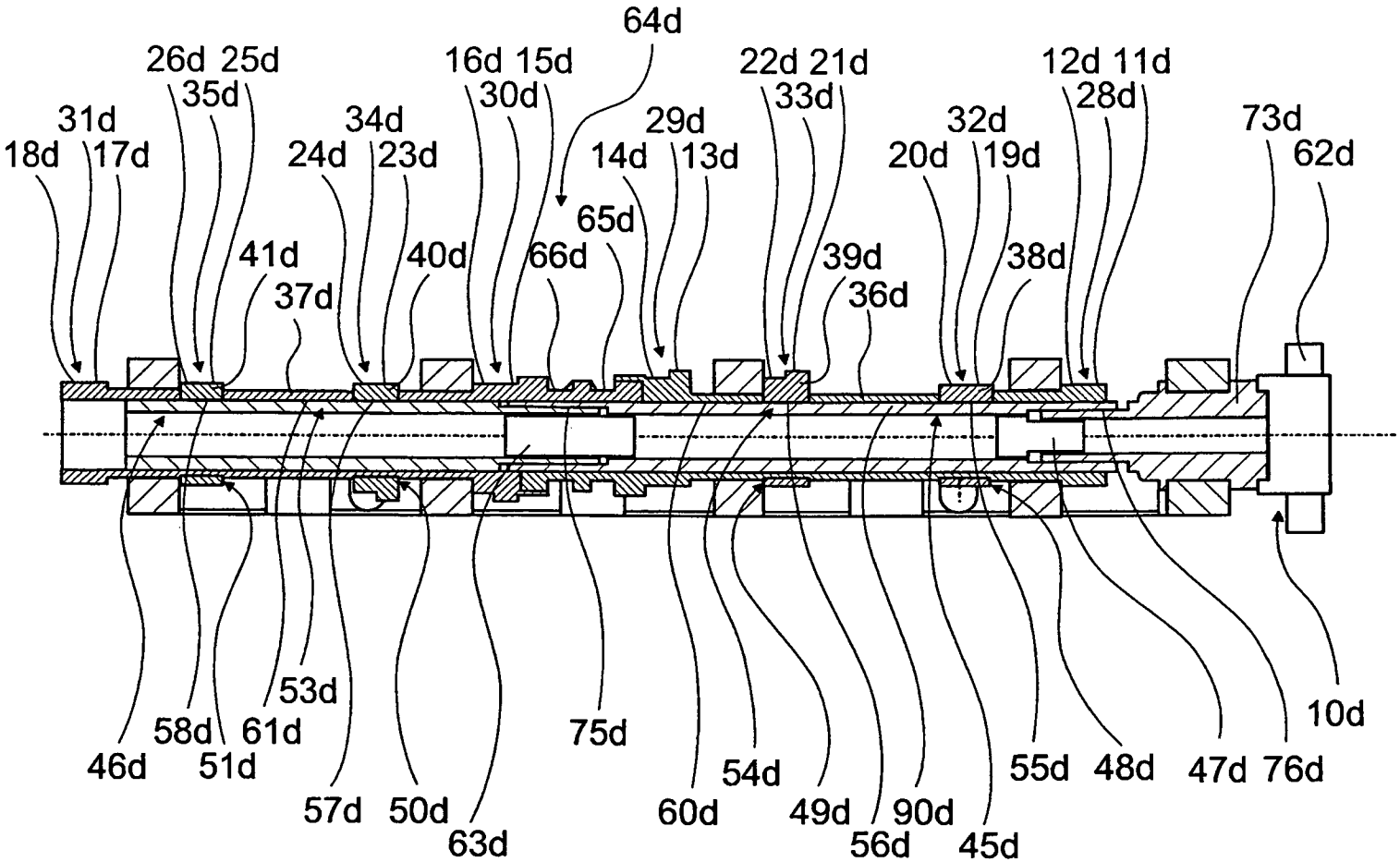
FIG. 6 is an axial cross-sectional view of a fourth valve drive train device.

FIGS. 4 to 6 show three further embodiments of the invention. To distinguish the embodiments from one another, the letter a used in the reference numbers of the embodiment shown in FIGS. 1 to 3 is replaced by the letters b to d in the reference numbers of the embodiments shown in FIGS. 4 to 6. The following description is essentially restricted to the differences with respect to the embodiment shown in FIGS. 1 to 3. For identical components, features and functions, we refer to the description of the embodiment shown in FIGS. 1 to 3 or to respective preceding embodiments.

FIG. 4 shows a valve drive train device having a modified primary drive shaft unit 43*b*. In contrast to the first embodiment, the primary drive shaft unit 43*b* of this valve drive train device is designed as a single piece. The primary drive shaft unit 43*b* is provided for driving primary cam elements 36*b*, 37*b*. The valve drive train device further comprises a secondary drive shaft unit 44*b* for driving the secondary cam elements 38*b*, 39*b*, 40*b*, 41*b*. The primary drive shaft unit 43*b* and the secondary drive shaft unit 44*b* are separate parts. By means of the secondary drive shaft unit 44*b*, a phase adjustment device 19*b* is provided for the adjustment of a phase position between primary cams 11*b*-18*b* and secondary cams 19*b*-26*b*.

The single-piece primary drive shaft unit 43*b* comprises a drive shaft connecting element 73*b* which is integrated with the primary drive shaft unit 43*b*. On a first side, the drive shaft connecting element 73*b* is coupled to a drive shaft link element 62*b* which is provided for connecting the primary drive shaft unit 43*b* to a crankshaft not shown in detail. The primary drive shaft unit 43*b* passes through the two primary cam elements 36*b*, 37*b* and the secondary cam elements 38*b*, 39*b*, 40*b*, 41*b*. The primary drive shaft unit 43*b* passes through a primary cam element 36*b* completely and through the primary cam element 37*b* partially.

A power flow for the two primary cam elements 36*b*, 37*b* runs via the drive shaft connecting element 73*b*. In the power flow, the two primary cam elements 36*b*, 37*b* are arranged parallel to each other. In order to transmit a total torque from the primary drive shaft unit 43*b* to the primary cam elements 36*b*, 37*b*, straight-toothed sliding seats 60*b*, 61*b* which engage each other are provided between the primary drive shaft unit 43*b* and the primary cam elements 36*b*, 37*b*. In this way, the primary cam elements 36*b*, 37*b* are axially displaceable on the primary drive shaft unit 43*b*, thereby providing a valve lift changeover.

FIG. 5 shows a valve drive train device having a modified primary and secondary drive shaft unit 45*c*. In contrast to the first embodiment, the valve drive train device has a common primary and secondary drive shaft unit 45*c* which drives two primary cam elements 36*c*, 37*c* and five secondary cam elements 38*c*, 39*c*, 40*c*, 41*c*, 42*c* in parallel.

The common primary and secondary drive shaft unit 45*c* comprises a hollow shaft 90*c* which is coupled to a drive shaft connecting element 73*c* of the primary and secondary drive shaft unit 45*c*. The hollow shaft 90*c* is axially displaceable with respect to the drive shaft connecting element 73*c*.

The drive shaft connecting element 73*c* of the primary and secondary drive shaft unit 45*c* is coupled to a drive shaft link element 62*c* on a first side. On the second side, the drive shaft connecting element 73*c* is coupled to the hollow shaft 90*c* of the primary and secondary drive shaft unit 45*c* by means of a polygonal connection 76*c*. The hollow shaft 90*c* passes through the primary cam element 36*c* completely and through more than half of the primary cam element 37*c*. By means of the drive shaft link element 62*c*, the primary cams 11*c*, 13*c*-18*c* and the secondary cams 19*c*-27*c* are coupled to a crankshaft not shown in detail. By means of a phase adjustment device 10*c*, a phase position of the primary and secondary drive shaft unit 45*c* can be adjusted with respect to the crankshaft.

The primary cam elements 36*c*, 37*c* and the secondary cam elements 38*a*, 39*c*, 40*c*, 41*c*, 42*c* are driven in parallel by means of the single-piece primary and secondary drive shaft unit 45*c*. The primary cam elements 36*c*, 37*c* and the secondary cam elements 38*c*, 39*c*, 40*c*, 41*c*, 42*c* are coupled to the primary and secondary drive shaft unit 45*c* by means of sliding seats 55*c*-61*c*. A common power flow is provided via the primary and secondary drive shaft unit 45*c* and transmitted to the primary cam elements 36*c*, 37*c* and the secondary cam elements 38*c*, 39*c*, 40*c*, 41*c*, 42*c* via the sliding seats 55*c*-61*c*.

The sliding seats 60*c*, 61*c* are straight-toothed and provided for the primary cam elements 36*c*, 37*c*. The sliding seats 55*c*, 56*c*, 57*c*, 58*c*, 59*c* have helical toothing and are provided for the secondary cam elements 38*a*, 39*c*, 40*c*, 41*c*, 42*c*.

By means of the helically toothed sliding seats 55*c*, 56*c*, 57*c*, 58*c*, 59*c*, a secondary phase adjusting means is formed for the adjustment of a phase position of the secondary cam elements 38*c*, 39*c*, 40*c*, 41*c*, 42*c*. Each of the helically toothed sliding seats 55*c*, 56*c*, 57*c*, 58*c*, 59*c* represents a secondary phase adjusting means for the adjustment of one of the secondary cam elements 38*a*, 39*c*, 40*c*, 41*c*, 42*c*. Each of the sliding fits 55*c*, 56*c*, 57*c*, 58*c*, 59*c* designed as secondary phase adjusting means is provided for the joint adjustment of the secondary cams 19*c*-27*c* of one of the pairs of cams. The helically toothed sliding seats 55*c*, 56*c*, 57*c*, 58*c*,59*c* of the secondary phase adjusting means may be designed differently, so that different phase positions can be adjusted for the secondary cams 19*c*-27*c* of the pairs of cams. By means of the helically toothed sliding seats 55*c*, 56*c*, 57*c*, 58*c*, 59*c*, a secondary phase adjusting unit 54*c* is implemented, by means of which a phase position of the secondary cams 19*c*-27*c* can be adjusted with respect to the primary cams 11*c*, 13*c*-18*c*.

The hollow shaft 90*c* of the primary and secondary drive shaft unit 45*c* is axially displaceable. The primary and secondary drive shaft unit 45*c* can be adjusted by means of a suitable adjustment actuator system 47*c*. In this context, an axial position of the primary and secondary drive shaft unit 45*c* can be adjusted to any intermediate values between two end position. An axial position the primary cam elements 36*c*, 37*c* and the secondary cam elements 38*c*, 39*c*, 40*c*, 41*c*, 42*c* relative to the fixed switching pins 67*c*, 68*c* can be adjusted by means of a gate 64*c*. By means of the gate 64*c*, the primary cam elements 36*c*, 37*c* and the secondary cam elements 38*c*, 39*c*, 40*c*, 41*c*, 42*c* can be placed in two switching positions. The primary cam element 36*c* and the secondary cam elements 38*c*, 39*c*, 42*c* of a first group and the primary cam element 37*c* and the secondary cam elements 40*c*, 41*c* of a second group are rotatably coupled to one another by means of coupling units 48*c*, 49*c*, 50*c*, 51*c*, 52*c* in an axially fixed arrangement. The coupling units 48*c*, 49*c*, 50*c*, 51*c*, 52*c* form a positive connection.

Owing to the helically toothed sliding seats 55*c*, 56*c*, 57*c*, 58*c*, 59*c*, a phase position of the secondary cam elements 38*c*, 39*c*, 40*c*, 41*c*, 42*c* is adjusted as a result of the displacement of the secondary cam elements 38*c*, 39*c*, 40*c*, 41*c*, 42*c* with respect to the primary and secondary drive shaft unit 45*c*. In order to adjust the phase position and to change the switching positions, the primary cam elements 36*c*, 37*c* and the secondary cam elements 38*c*, 39*c*, 40*c*, 41*c*, 42*c* have four basic modes of operation.

In a first mode, the primary cam elements 36*c*, 37*c* and the secondary cam elements 38*c*, 39*c*, 40*c*, 41*c*, 42*c* are in a neutral phase position, i.e. a phase position between the primary cam elements 36*c*, 37*c* and the secondary cam elements 38*c*, 39*c*, 40*c*, 41*c*, 42*c* is defined as zero. The primary cam elements 36*c*, 37*c* and the secondary cam elements 38*c*, 39*c*, 40*c*, 41*c*, 42*c* are moved to the first switching position in the first mode, causing a valve actuation by means of the primary cams 11*c*, 13*c*-18*c* and the secondary cams 19*c*-27*c* which are assigned to the first switching position. In the first mode, the primary and secondary drive shaft unit 45*c* is not displaced, i.e. it remains in a central neutral position between the two end positions.

In a second mode, the primary cam elements 36*c*, 37*c* and the secondary cam elements 38*c*, 39*c*, 40*c*, 41*c*, 42*c* are in the neutral phase position. The primary cam elements 36*c*, 37*c* and the secondary cam elements 38*c*, 39*c*, 40*c*, 41*c*, 42*c* are moved to the second switching position in the second mode. In the second mode, the primary and secondary drive shaft unit 45*c* is displaced in a first direction. In order to switch from the first mode to the second mode, both the primary cam elements 36*c*, 37*c* and the secondary cam elements 38*c*, 39*c*, 40*c*, 41*c*, 42*c* as well as the primary and secondary drive shaft unit 45*c* are axially displaced evenly in a first direction.

In a third mode, the primary cam elements 36*c*, 37*c* and the secondary cam elements 38*c*, 39*c*, 40*c*, 41*c*, 42*c* are displaced relative to one another by a phase position not equal to zero. The primary cam elements 36*c*, 37*c* and the secondary cam elements 38*c*, 39*c*, 40*c*, 41*c*, 42*c* are moved to the second switching position in the third mode. In the third mode, the primary and secondary drive shaft unit 45*c* is not displaced. In order to switch from the first to the third mode, only the primary cam elements 36*c*, 37*c* and the secondary cam elements 38*c*, 39*c*, 40*c*, 41*c*, 42*c* are displaced axially.

In a fourth mode, the primary cam elements 36*c*, 37*c* and the secondary cam elements 38*c*, 39*c*, 40*c*, 41*c*, 42*c* are displaced relative to one another by a phase position not equal to zero. The primary cam elements 36*c*, 37*c* and the secondary cam elements 38*c*, 39*c*, 40*c*, 41*c*, 42*c* are moved to the first switching position in the fourth mode. In the fourth mode, the primary and secondary drive shaft unit 45*c* is axially displaced in one direction. In order to switch from the first to the fourth mode, only the primary and secondary drive shaft unit 45*c* is axially displaced in the first direction.

The pair of cams 28*c* is designed as a mixed pair of cams. It comprises the primary cam 11*c* and the secondary cam 27*c*, which are arranged immediately adjacent to each other. The secondary cam 27*c* is disposed on its own cam element, which is connected to the primary and secondary drive shaft unit 45*c* by means of a helically toothed sliding seat 59*c*. By means of the helically toothed sliding seat 59*c*, the secondary cam 27*c* can be turned with respect to the primary cam 11*c* by one phase position independent of the primary cam 11*c*.

FIG. 6 shows a valve drive train device which, in contrast to the embodiment of FIG. 5, has a modified sliding seat 60*d* for connecting a primary cam element 36*d* to a primary and secondary drive shaft unit 45*d*. In contrast to the embodiment of FIG. 5, the sliding seat 60*d* is helically toothed.

The helically toothed sliding seat 60*d* is oriented in the opposite direction to the helically toothed sliding seats 55*d*, 56*d*. In this way, a phase position of the primary cam element 36*d* is adjusted relative to a crankshaft not shown in detail by an axial displacement of the primary and secondary drive shaft unit 45*d*. Owing to an opposite orientation of the helically toothed sliding seat 60*d*, the primary cam element 36*d* and the secondary cam elements 38*d*, 39*d* are adjusted in different directions with respect to the crankshaft.

In order to adjust the primary and secondary drive shaft unit 45*d*, the valve drive train device comprises an adjustment actuator system 47*d*. The adjustment actuator system 47*d* is at least partially accommodated within a hollow shaft 90*d*. By means of the sliding seats 55*d*, 56*d*, a secondary phase adjusting unit 54*d* is implemented, by means of which a phase position of secondary cams 19*d*, 20*d*, 21*d*, 22*d* can be adjusted with respect to the crankshaft. By means of the sliding seat 60*d*, a primary phase adjusting unit 53*d* is implemented, by means of which a phase position of primary cams 11*d*, 12*d*, 13*d*, 14*d* can be adjusted with respect to the crankshaft. The phase position of the primary cams 11*d*, 12*d*, 13*d*, 14*d* and the phase position of the secondary cams 19*d*, 20*d*, 21*d*, 22*d* is adjusted jointly, but in opposite directions, whereby a phase position between the primary cams 11*d*, 12*d*, 13*d*, 14*d* and the secondary cams 19*d*, 20*d*, 21*d*, 22*d* can be adjusted.

The valve drive train device further comprises a further primary and secondary drive shaft unit 46*d* which is independent of the first primary and secondary drive shaft unit 45*d* at least with respect to an adjustment of a phase position of the secondary cams 23*d*, 24*d*, 25*d*, 26*d* mounted thereon. The two primary and secondary drive shaft units 45*d*, 46*d* are non-rotatably coupled to each other but axially displaceable relative to each other.

A primary cam element 37*d* and secondary cam elements 40*d*, 41*d* are coupled to the primary and secondary drive shaft unit 46*d* by means of sliding seats 57*d*, 58*d*, 61*d*. The sliding seats 57*d*, 58*d*, 61*d* are helically toothed and designed as phase adjusting means of the secondary cams 23*d*, 24*d*, 25*d*, 26*d*. The sliding seat 61*d* is likewise helically toothed, the helically toothed sliding seat 61*d* being oriented in the opposite direction to the helically toothed sliding seats 57*d*, 58*d*. The helically toothed sliding seats 57*d*, 58*d* are oriented in the same direction as the sliding seats 55*d*, 56*d*.

In order to adjust the primary and secondary drive shaft unit 46*d*, the valve drive train device comprises a second adjustment actuator system 63*d*. The adjustment actuator system 63*d* is located between the two primary and secondary drive shaft units 45*d*, 46*d* and adjusts the primary and secondary drive shaft unit 46*d* relative to the primary and secondary drive shaft unit 45*d*. The adjustment actuator system 63*d* is axially located at the level of the gate. In principle, however, the adjustment actuator system 63*d* may be located between a stationary component and the primary and secondary drive shaft unit 46*d*. By means of the sliding seats 57*d*, 58*d*, the secondary phase adjusting unit 54*d* can adjust a phase position of the secondary cams 23*d*, 24*d*, 25*d*, 26*d*. By means of the sliding seat 61*d*, the primary phase adjusting unit 53*d* can adjust a phase position of the primary cams 15*d*, 16*d*, 17*d*, 18*d*. The phase position between the primary cams 11*d*, 12*d*, 13*d*, 14*d* and the secondary cams 19*d*, 20*d*, 21*d*, 22*d* can be adjusted independently of a phase position between the primary cams 15*d*, 16*d*, 17*d*, 18*d* and the secondary cams 23*d*, 24*d*, 25*d*, 26*d*.

What is claimed is:

1. A valve drive train device of an internal combustion engine of a motor vehicle, comprising a cam shaft with a primary drive shaft unit (43*a*, 43*b*) provided with axially movable cam elements (36*a*, 37*a*; 36*b*, 37*b*) and a secondary driveshaft unit (44*a*, 44*b*) rotatably disposed within the primary drive shaft unit (43*a*, 43*b*), a first phase adjustment device (10*a*; 10*b*) for the adjustment of a phase position of primary cams (11*a*-18*a*; 11*b*-18*b*) disposed on the cam elements (36*a*, 37*a*; 36*b*, 37*b*) of the primary drive shaft unit (43*a*, 43*b*) 43*a*, 43*b*) for rotation therewith and a second cam adjustment device (54*a*, 54*b*) for adjusting the phase position of secondary cams (19*a*-26*a*; 19*b*-26*b*) which are arranged rotatably on the cam elements (36*a*, 37*a*; 36*b*, 37*b*) coaxially with the primary cams but connected to the secondary drive shaft unit (44*a*, 44*b*) for rotation therewith, each of the primary cams (11*a*-18*a*; 11*b*-18*b*) and each of the secondary cams (19*a*-26*a*; 19*b*-26*b*) including at least two cam structures with different lobe heights arranged adjacent one another and being axially movable with the respective cam elements (36*a*, 37*a*; 36*b*, 37*b*) for selective engagement with a respective engine valve for varying the lift of the respective engine valve, the primary cams (11*a*-18*a*, 11*b*-18*b*) and the secondary cams (19*a*,-26*a*; 19*b*-26*b*) being also rotatable relative to each other together with the primary and, respectively, secondary drive shaft units for adjusting the relative phase position of the primary and the secondary cams.

2. The valve drive train device according to claim 1, wherein the cam elements (36*a*, 37*a*; 36*b*, 37*b*) are coupled to each other by a gate structure (64*a*, 64*b*) for axially displacing the cam elements (36*a*, 37*a*, 36*b*, 37*b*) together with the primary and secondary cams (28*a*, 29*a*, 30*a*, 31*a*, 32*a*, 33*a*, 34*a*, 35*a*; 28*b*, 29*b*, 30*b*, 31*b*, 32*b*, 33*b*, 34*b*, 35*b*).

3. The valve drive train device according to claim 2, wherein, by axial displacement, the cam elements (36,*a*, 37*a*; 36*b*, 37*b*) or the secondary cams (28*a*-41*a*, 28*b*-41*b*), each of which has two switch positions, is switchable from a first position assigned to the primary cams (11*a*-18*a*; 11*b*-28*b*) and, to a second position assigned to the secondary cams (19*a*-26*a*; 19*b*-26*b*).

4. The valve drive train device according to claim 3, wherein the gate structure (64*a*) includes two gateways (63*a*, 66*a*) for sequential axial displacement of the primary cam elements (36*a*, 37*a*).

* * * * *